United States Patent [19]

Stone

[11] Patent Number: 4,832,838

[45] Date of Patent: May 23, 1989

[54] METHOD AND APPARATUS FOR WATER CALCULATION AND FILTRATION

[75] Inventor: Damon K. Stone, 5007 NW. 34th St., Ridgeway Village, Gainesville, Fla. 32605

[73] Assignee: Damon K. Stone, Gainesville, Fla.

[21] Appl. No.: 888,368

[22] Filed: Jul. 23, 1986

[51] Int. Cl.[4] ..... E04H 3/20

[52] U.S. Cl. ..... 210/169; 210/416.2; 4/490; 4/492; 15/1.7; 134/167 R

[58] Field of Search ..... 210/776, 169, 416.2; 4/490, 492; 134/167 R, 168 R; 15/1.7

[56] References Cited

U.S. PATENT DOCUMENTS

| | | | |
|---|---|---|---|
| 1,762,314 | 6/1930 | Sutphen et al. | 210/752 |
| 3,247,969 | 4/1966 | Miller | 210/169 |
| 3,384,914 | 5/1968 | Wilhelmsen | 15/1.7 |
| 3,675,252 | 7/1972 | Ghiz | 4/492 |
| 3,689,408 | 9/1972 | Edmiston et al. | 210/169 |
| 3,794,052 | 2/1974 | Koble, Jr. et al. | 134/167 |
| 3,822,754 | 2/1974 | Henkin et al. | 15/1.7 |
| 3,932,281 | 1/1976 | Pansini | 210/163 |
| 4,114,206 | 9/1978 | Franc | 4/490 |
| 4,188,673 | 2/1980 | Carter | 134/167 R |
| 4,193,870 | 3/1980 | Goodin | 210/65 |
| 4,349,434 | 9/1982 | Jaworski | 210/94 |
| 4,430,214 | 2/1984 | Baker | 210/169 |
| 4,560,418 | 12/1985 | Raubenheimer | 15/1.7 |

*Primary Examiner*—Benoit Castel
*Assistant Examiner*—Richard D. Jordan
*Attorney, Agent, or Firm*—Schwaab Mack, Blumenthal & Evans Foley & Lardner, Schwartz Jeffrey

[57] ABSTRACT

In a vessel such as a swimming pool, a turbine device is positioned on the bottom of the vessel to create an upward flow of water. The upward flow carries with it any larger debris, which are thereafter carried along the edge of the vessel and recovered by a skimmer. The turbine device is powered by the suction stream of a fluid circulation pump and filter system. Suction is thus created along the bottom of the vessel, which removes small debris. The upward flow of the turbine device is created by a plurality of spaced outlets which surrounds an impeller inlet. The outlets form high velocity streams which are spaced in a manner to exclude large debris from entering the impeller inlet.

9 Claims, 4 Drawing Sheets

METHOD AND APPARATUS FOR WATER CALCULATION AND FILTRATION

BACKGROUND OF THE INVENTION

The present invention relates to water circulation and filtration apparatus, and particularly to such apparatus as used in swimming pools. A turbine device is provided on the bottom of the pool and is run by a flow of water, for example, the suction flow to a water filtration pump. The turbine device includes a first turbine, i.e., an impeller which circulates water from the bottom of the pool to the surface in a continuous stream. The continuous stream carries with it any large debris which may have accumulated in the pool. A second turbine is mechanically connected to the first turbine and is rotated by the flow of water. The invention also provides for a unique arrangement which excludes debris from the first turbine.

A major problem associated with the maintenance of swimming pools, particularly outdoor pools, is the removal of debris such as dirt, leaves, trash and the like, which can accumulate both on and below the water surface as a result of normal use. To remove such debris, the pool is usually provided with a circulation pump and filter system, the filtration being effected by passing a stream of water from the pump discharge through one or a series of filters and thereafter returning the filtered stream to the pool.

This type of filtration is generally adequate for removal of small debris particles. Care must be taken, however, to prevent entrainment of large debris into the pump suction, as this can result in damage to the pump and/or clogging of the filter system. Large material is therefore excluded from the pump suction stream through a grating or like structure at the stream entrance.

Two problems are associated with this arrangement. First, large pieces of debris may adhere to the suction stream grating, thereby excluding flow to the circulation pump. Second, the large debris must be removed from the pool through some external means, such as manual skimming of the water surface. Manual skimming is, however, a time consuming procedure. Further, skimming does not provide for recovery of large debris which cannot be brought readily to the water surface, that is, debris having a neutral or negative buoyancy.

DISCLOSURE OF THE INVENTION

It is accordingly an object of the invention to provide a method and apparatus for circulating and filtering a body of water, such as in a swimming pool, wherein large debris can readily be removed.

It is another object of the invention to provide a method and apparatus, as above, which reduces or eliminates the need for manual skimming the surface of the body of water to remove debris.

It is yet another object of the invention to provide a method and apparatus, as above, which can be adapted to an existing pool filtering system having a circulation pump.

It is still another object of the invention to provide a method and apparatus, as above, which prevents entrainment of large debris into the suction of the circulation pump.

It is yet another object of the invention to provide a method and apparatus, as above, which provides an upward flow of water from the bottom of the pool for guiding large debris from the pool bottom to the pool surface, and thereafter toward the edge of the pool.

It is still another object of the invention to provide a method and apparatus, as above, which provides for an upward flow of water from the pool bottom by utilizing the suction stream of the circulation pump as a power source, thereby reducing energy and maintenance costs.

These objects are achieved by a water circulation and filtration apparatus for a vessel containing a body of water, which comprises (a) a filtering means for filtering the body of water, the filtering means including means for pumping unfiltered water from the body of water and through the filter, and returning the filtered water back to the vessel; and (b) a turbine device positioned on the bottom of the vessel, the device including first and second turbines which are mechanically connected and fluidly isolated from each other, the first turbine including inlet and outlet ports which both communicate with the body of water, the outlet port facing upwards towards the water surface and the inlet port including means for receiving water adjacent the bottom of the vessel, the second turbine including inlet and outlet ports, the inlet port thereof communicating with the water along the vessel bottom and the outlet port of the second turbine communicating with the pumping means, the pumping means sucking water through the second turbine and thereby effecting rotation of the second turbine, which in turn rotates the first turbine through the mechanical connection, the rotating first turbine receiving water from the body of water and discharging it towards the water surface.

The objects of the invention are also achieved by a water circulation and filtration apparatus for a swimming pool, which comprises (a) pumping means for pumping a flow of water from the pool, through a first filtering means, and back to the pool; (b) turbine means powered by the flow of water, the turbine means including a suction port and producing an upward flow of water from the bottom to the surface of the water, the upward flow being thereafter diverted at the surface to the outer edges of the pool, the turbine means including exclusion means for preventing large debris above a predetermined size from entering the suction port, the large debris instead being carried by the upward flow and directed to the outer edges of the pool; and (c) second filtering means for removing the large debris from the pool.

The objects of the invention are further achieved by a method for circulating and filtering water in a vessel, which comprises the steps of (a) positioning a turbine below the water surface, the turbine having inlet and outlet ports communicating with the water in the vessel; (b) rotating the turbine to thereby suck water into, and discharge water from the turbine; (c) directing upwardly toward the water surface a discharge water stream from the turbine; (d) excluding large debris from entering the turbine inlet and simultaneously carrying the large debris to the water surface by means of the discharge water stream; and (e) recovering the large debris along the edge of the vessel.

BRIEF DESCRIPTION OF THE DRAWINGS

For a full understanding of the true scope of the invention, the following detailed description is to be read in conjunction with the drawings, wherein.

DETAILED DESCRIPTION OF THE PREFERRED EMBODIMENTS

Figure 1:
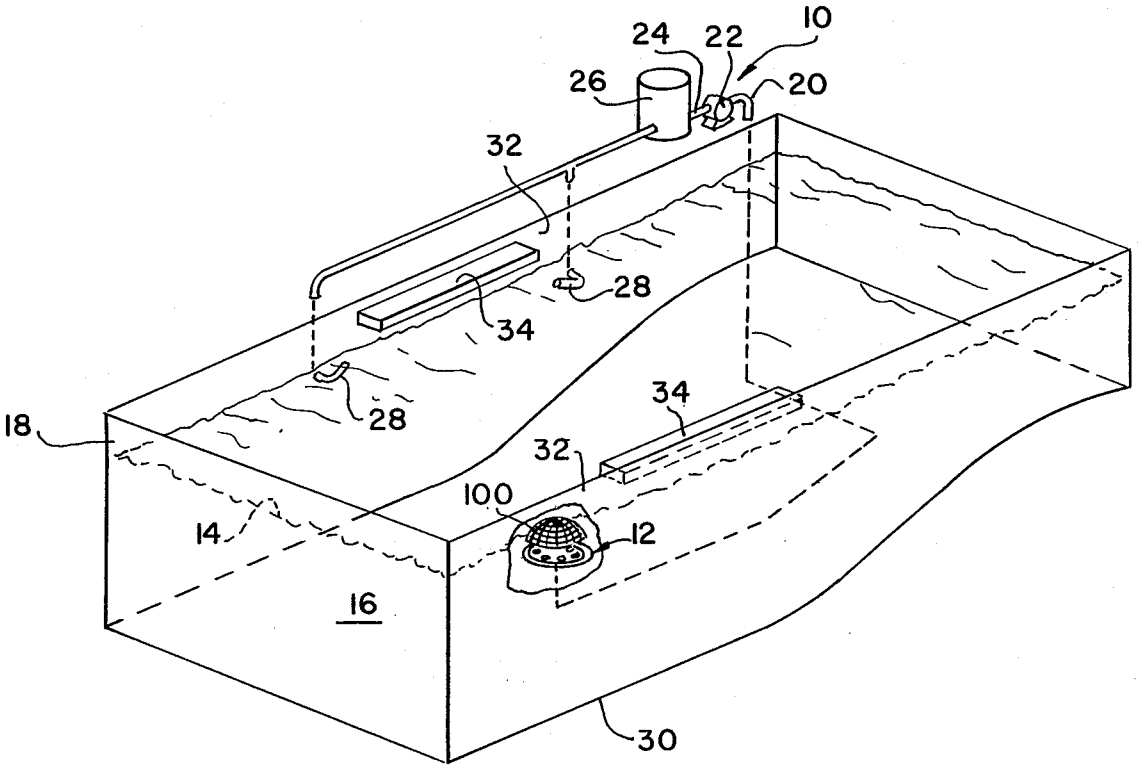
FIG. 1 is a perspective view of one embodiment of the invention installed in a swimming pool.

A typical application of the invention is illustrated in FIG. 1, wherein a water circulation and filtration apparatus of the invention is indicated generally by the number 10. A turbine device 12 is located below the water surface 14 of a body of water 16 contained in a vessel such as a swimming pool 18. The turbine device 12 is fluidly connected to the suction inlet 20 of a circulation pump 22. The discharge 24 of the pump connects with a filter 26 for filtering small debris from the water. The now filtered water is returned to the pool via a plurality of return jets 28 which are directed so as to guide the debris reaching the surface to the skimmers 34. The skimmers 34 are placed along the edge of the pool wall 32 and remove debris (e.g. large debris) from the water surface. While two skimmers are illustrated, one or more than two skimmers 34 can be used.

Figure 2:
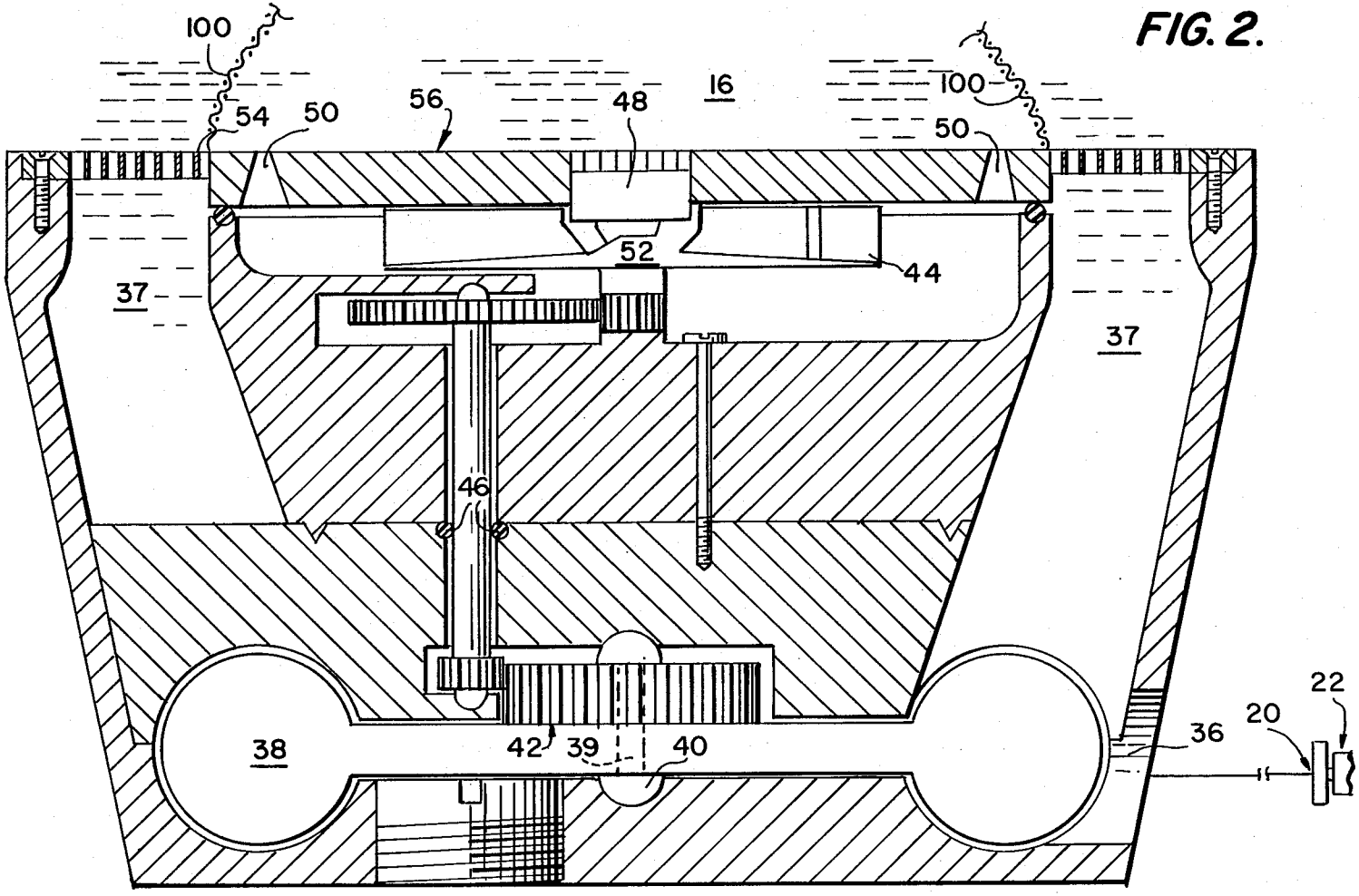
FIG. 2 is a cross sectional view of one embodiment of a turbine device of the invention.
Figure 3:
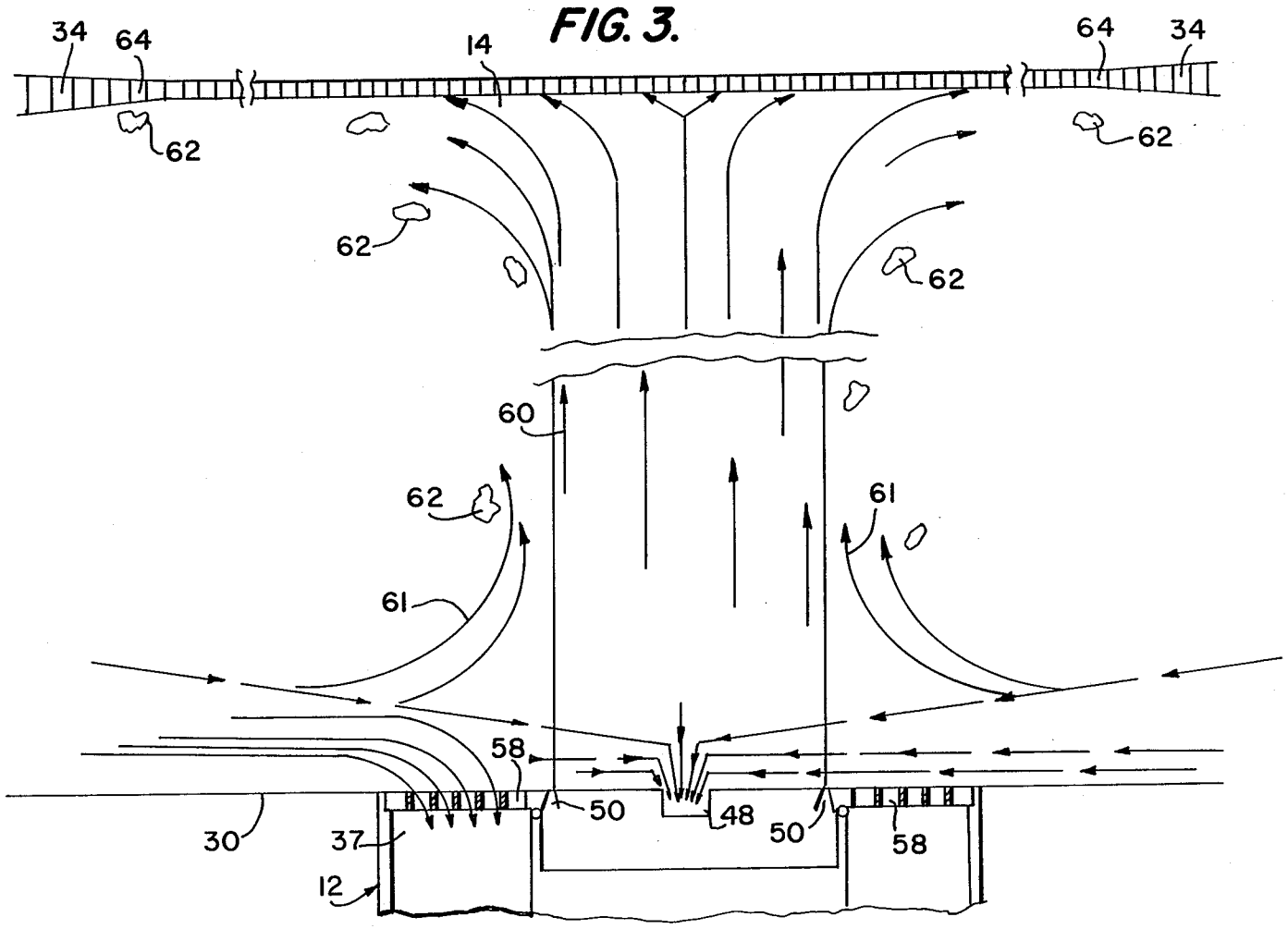
FIG. 3 is a schematic representation of a flow pattern produced by the apparatus of the invention in a swimming pool.

The construction of the turbine device and the flow pattern it creates in the pool are illustrated in FIGS. 2 and 3, respectively. A first outlet port 36 is connected to the suction inlet 20 of the circulation pump 22. Water is drawn into the turbine device via an inlet port 37 which is preferably circular. As the water is drawn in, it strikes a turbine fin 38 and causes the latter to spin about an axis 39 formed by a bearing seat 40. A gear mechanism 42 rotatably connects the turbine fin 38 to an impeller 44, the latter being rotated at a speed which is a function of the gearing ratio. The turbine fin 38 and the impeller 44 are fluidly isolated from each other by a sealing means such as an O-ring 46.

The impeller has an inlet 48 and a plurality of outlets 50. Both the inlet 48 and the outlets 50 communicate with the body of water 16, such that water is drawing into the inlet, which is preferably located along the axis of rotation 52 of the impeller 44. The water is discharged through the outlets 50 located along the periphery 54 of the impeller housing 56 containing the impeller.

The spacing of the outlets 50 is an important feature of the invention. By arranging the outlets in a closed pattern such as a circle, oval, etc. with a specified distance between each outlet, large debris can be excluded from entering the impeller inlet and thereby damaging the impeller. That is, the upward streams of water passing through the outlets 50 exclude from the space within the closed pattern material having a size larger than the distance between the outlets. At the same time, the distance between the outlets is not so small that water cannot flow between the outlets and into the impeller inlet. Depending on the size of the turbine device, which varies with the size and depth of the pool or vessel, the amount of circulation desired, etc., the spacing between the outlets 50 can be from about $\frac{1}{8}$ to 2 inches and are preferably between about 174 to about 1 inch.

The shape of the outlets 50 is also important to the proper functioning of the invention. Generally, the outlets 50 are nozzle shaped to impart sufficient velocity to the exiting water streams such that the streams function in the above-described manner to exclude large debris. Preferably, the superficial velocity of the water exiting the outlets is between about 0.5 and about 5 feet per second, with from about 1 and about 3 feet per second preferred. The discharged, high velocity water forms a selective barrier to large debris, the latter being carried upwards along the outer edge of the upward stream to the surface of the water. This is illustrated most clearly in FIG. 3.

In FIG. 3, the operation of the circulation and filtration apparatus of the invention is shown schematically. The turbine device 12, exaggerated in size in this figure for purposes of clarity, is installed preferably on a pool bottom 30 with the inlet port 37 flush with the bottom 30 and facing upward. The inlet port 37 includes a filter grate 58 which prevents large debris from entering the device and damaging the turbine fin. Water which is free of large debris can also enter the impeller inlet 48 between the outlet ports 50, as described previously. The upward flow of water 60 creates an upward draft 61 which entrains large debris 62 and prevents the latter from adhering to the filter grate 58. The large debris are carried to the water surface 14 and thereafter to the edge 64 of the pool where the skimmers 34 pick up the debris and remove it from the pool. In the above described manner, both large and small debris are filtered from the body of water, the small debris entering the suction of the circulation pump via the turbine fin inlet port 37, and the large debris being removed by the skimmer or skimmers. Debris material of either negative, neutral or positive buoyancy can thereby be recovered, since the upward flow 60 causes entrainment of large debris which overcomes buoyancy effects. Of course, smaller debris not passing through grate 58 can also be entrained with the upward flow 60 and are also removed by the skimmers.

It is also possible to recover debris by placing a shroud 100 above the turbine device. The shroud 100 is preferably in the form of a bag and has an open weave to allow free flow of water therethrough. Thus the upward flow 60 remains unimpeded. Debris carried by the upward flow are trapped in the shroud, which can be removed from the turbine device and emptied periodically.

Figure 4:
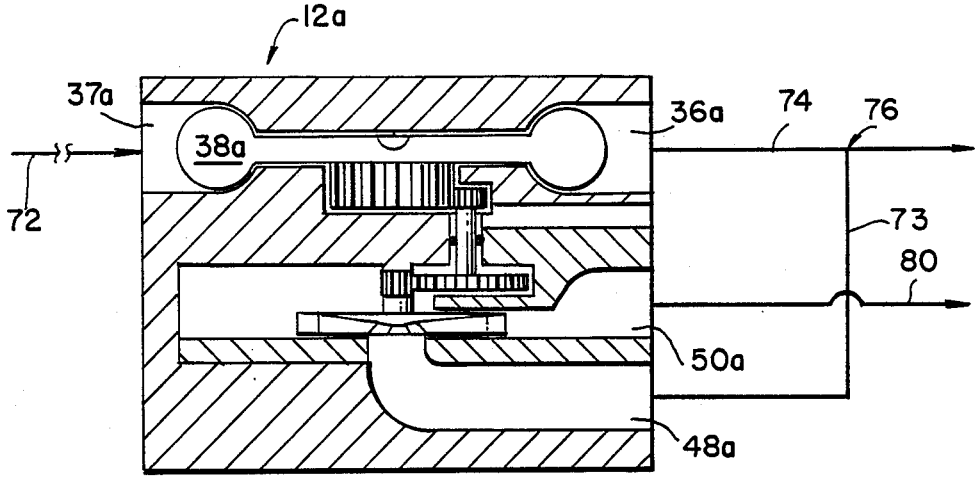
FIG. 4 is a cross sectional view of a second embodiment of the turbine device of the invention.
Figure 5:
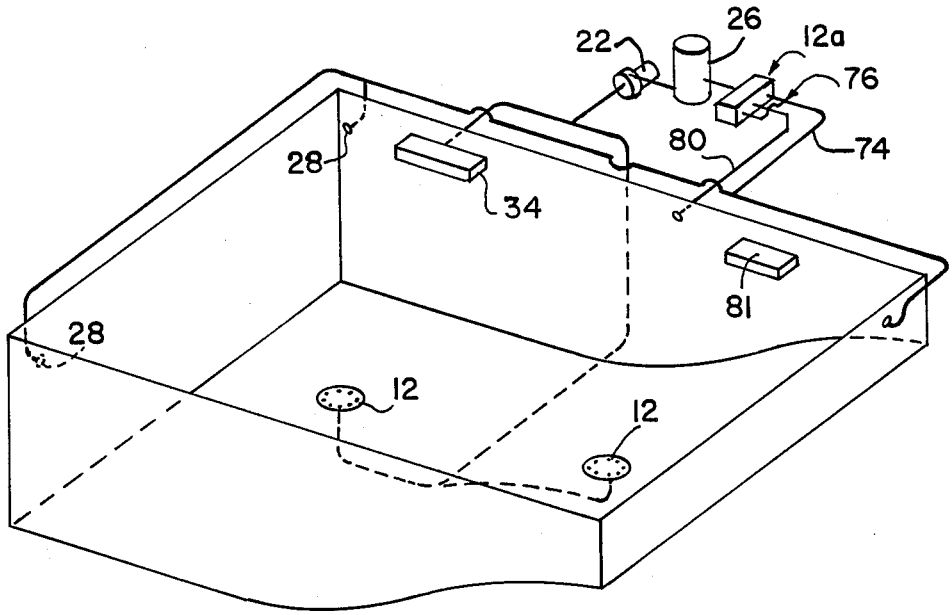
FIG. 5 is a perspective view of a second application of the invention in a swimming pool.

FIGS. 4 and 5 illustrate another embodiment of a turbine device of the invention. In this embodiment, discussion of elements similar to those previously described will be omitted. An outlet 72 from filter 26 is connected to inlet port 37*a* of a turbine device 12*a*. Fluid flow from filter 26 strikes the turbine fin 38*a* and is thereafter discharged through outlet port 36*a*. Return jets 28 return the filtered water to the pool as previously described. A return conduit 74 includes a "T" 76 which bifurcates the fluid flow and provides for a feedback conduit 78 connected to the inlet 48*a* to the impeller. Water is discharged through outlet 50*a* and connects to the pool through a conduit 80 (FIG. 5). One or more automatic pool cleaners 81, which can be powered by water pressure and are well known in the art, can be employed in the pool and supplied by water pressure from the conduit 80. Also illustrated in FIG. 5 are a plurality of turbine devices 12 as previously described, an automatic skimmer 34, and return jets 28.

The second application of the turbine device of the invention provides the following advantages. First, water can be supplied through a means not requiring electrical current, that is, pressurized water is supplied from the already existing stream of water discharged from the pool filter. In this capacity, the turbine 12*a* device of the invention could also be used to create additional pressurized water inlets to the body of water. This is of particular importance in smaller bodies of water, such as in a spa or hot tub.

In these latter applications, the additional circulation can also include jets which are designed to create air in the stream of water. As applied to a swimming pool utilizing an automatic pool cleaner, the turbine device is of great benefit because it would activate the pool cleaner only when the normal filter system is being used. That is, when the filter system is inactivated, no water pressure is obtained through the feedback conduit 78 and through the conduit 80. Timer switches and the need for a separate booster pump could thereby be eliminated. In the prior art, timers were necessary for providing an electric booster pump to be turned on at the same time the filter system comes on, since otherwise the booster pump would draw air through the filter system which in turn would cause cavitation and overheating of the booster pump.

Utilization of the turbine device 12*a* of the invention rather than an electric powered booster pump prevents this, since it is activated only after the circulation pump has produced sufficient fluid flow through the filter for driving the turbine fin. Moreover, the turbine device needs no external cooling, since the drive mechanism is water cooled by the fluid flow from the filter.

The turbine device of the invention can also be used in applications other than those described above. For example, it can be used as a portable water pump for removing standing water which often accumulates on a pool cover. For this application, the "T" 76 is eliminated, and the inlet 48*a* is placed in fluid communication with the standing water.

The turbine device can also be used in an irrigation system and thereby be of great benefit to the farming industry, because it would enable the farmer to water a much larger area with one electric pump plumbed into a series of turbine devices. Another use is in water treatment plants, where multiple functions could be performed at a reduced cost.

The foregoing description of preferred embodiments has been set forth merely to illustrate the invention and is not intended to be limiting. Since modifications of the described embodiments incorporating the spirit and substance of the invention may occur to persons skilled in the art, the scope of the invention should be limited solely with respect to the appended claims and equivalents.

What is claimed is:

1. A water circulation and filtration apparatus for a vessel containing a body of water, comprising:

(a) filtering means for filtering said body of water, said filtering means comprising pumping means including conduits, for pumping unfiltered water from said body of water through said filter, and returning filtered water to said vessel; and (b) a turbine device positioned on the bottom of said vessel and including first and second rotational turbines, said turbines being connected via a mechanical connection and fluidly isolated from each other;

said first turbine including first inlet and outlet ports communicating with the body of water, said first outlet port facing upwards toward the surface of said body of water, said first inlet port including means for receiving water from along said bottom of said vessel;

said second turbine including second inlet and outlet ports, said second inlet port being in fluid communication with said body of water and said second outlet port communicating with said pumping means, said pumping means sucking water through said second turbine and thereby rotating said second turbine;

said second turbine having means to impart rotation to said first turbine through said mechanical connection, said first turbine receiving water from said body of water via said first inlet port and discharging water via said first outlet port in a direction towards the surface of said body of water; and a shroud means covering said first outlet port for catching debris.

2. An apparatus as claimed in claim 1, wherein said first outlet port includes nozzle means comprising a plurality of nozzles.

3. An apparatus as claimed in claim 2, wherein said nozzles are arranged to form a perimeter and are spaced from each other, and wherein said first inlet port is positioned inside said perimeter.

4. An apparatus as claimed in claim 3, wherein said perimeter is in the form of a circle, and wherein the spacing between said nozzles is from about $\frac{1}{8}$ to about 2 inches.

5. An apparatus as claimed in claim 3, wherein the spacing between said nozzles is from about $\frac{1}{4}$ to about 1 inch.

6. An apparatus as claimed in claim 2, wherein said nozzles are arranged to form from water exiting said nozzles a plurality of spaced upward streams, said upward streams forming a barrier to large debris wider than said spacing of said nozzles, thereby preventing said large debris from passing between said upward streams and into said first inlet port.

7. An apparatus as claimed in claim 6, wherein said nozzles are oriented such that said large debris is propelled by said upward streams to said surface of said body of water, and wherein said nozzles are constructed such that said upward streams have a superficial velocity at the exit of said nozzles of from about 0.5 to about 5 feet per second.

8. An apparatus as claimed in claim 1 wherein said shroud means comprises a bag having an open weave to allow the free flow of water therethrough.

9. An apparatus, comprising:

a housing having a first turbine chamber having a first inlet and a first outlet, and a second turbine chamber having a second inlet and a second outlet;

a first turbine contained in said first turbine chamber;

a second turbine contained in said second turbine chamber;

means for connecting said first and second turbines, such that rotation of said first turbine causes rotation of said second turbine;

means for preventing large debris from entering said first and second inlets;

a fluid and debris flow path extending across said first inlet and across said second inlet to said second outlet, such that fluid drawn through said first inlet through said first turbine chamber and out said first outlet causes rotation of said first turbine, and said second turbine rotating in response to said first turbine to draw a portion of said fluid into said second inlet to pressurize said portion of fluid and force said portion of said fluid out of said second outlet drawing debris along said flow path and forcing said debris away from said second outlet; and a shroud means covering said second outlet to catch said debris.

* * * * *

UNITED STATES PATENT AND TRADEMARK OFFICE

CERTIFICATE OF CORRECTION

PATENT NO. : 4,832,838

DATED : May 23, 1989

INVENTOR(S) : Damon K. Stone

It is certified that error appears in the above-identified patent and that said Letters Patent is hereby corrected as shown below: Title page:

On line 75 of the first page, the inventors should include:

Stephen A. Scott, 728 Northwest 8th Avenue, Gainesville, Florida 32601.

On line 54, the title should read --Method and Apparatus for Water Circulation and Filtration-- and not "Method and Apparatus for Water Calculation and Filtration"

Signed and Sealed this

Twentieth Day of February, 1990

*Attest:*

JEFFREY M. SAMUELS

*Attesting Officer*

*Acting Commissioner of Patents and Trademarks*